US010144986B2

(12) United States Patent
Kim et al.

(10) Patent No.: US 10,144,986 B2
(45) Date of Patent: Dec. 4, 2018

(54) ULTRAHIGH-STRENGTH STEEL SHEET AND MANUFACTURING METHOD THEREFOR

(71) Applicant: POSCO, Pohang-si, Gyeongsangbuk-do (KR)

(72) Inventors: Sung-Kyu Kim, Gwangyang-si (KR); Won-Tae Cho, Gwangyang-si (KR); Tai-Ho Kim, Gwangyang-si (KR); Kwang-Geun Chin, Gwangyang-si (KR); Sang-Ho Han, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 304 days.

(21) Appl. No.: 14/911,709

(22) PCT Filed: Aug. 14, 2013

(86) PCT No.: PCT/KR2013/007350

§ 371 (c)(1),
(2) Date: Feb. 11, 2016

(87) PCT Pub. No.: WO2015/023012

PCT Pub. Date: Feb. 19, 2015

(65) Prior Publication Data

US 2016/0186285 A1 Jun. 30, 2016

(51) Int. Cl.
*C22C 38/00* (2006.01)
*C21D 9/46* (2006.01)
(Continued)

(52) U.S. Cl.
CPC ..... *C21D 9/46* (2013.01); *B21B 3/02* (2013.01); *C21D 6/004* (2013.01); *C21D 6/005* (2013.01);
(Continued)

(58) Field of Classification Search
CPC ..... C22C 38/58; C21D 6/004
See application file for complete search history.

(56) References Cited

U.S. PATENT DOCUMENTS 5,647,922 A 7/1997 Kim et al.
8,926,772 B2 1/2015 Bouzekri et al.
(Continued)

FOREIGN PATENT DOCUMENTS

CN 101346480 A 1/2009
CN 101432456 A 5/2009
(Continued)

OTHER PUBLICATIONS

International Search Report dated May 14, 2014 issued in International Patent Application No. PCT/KR2013/007350 (English translation).
(Continued)

*Primary Examiner* — Scott R Kastler
(74) *Attorney, Agent, or Firm* — McDermott Will & Emery LLP

(57) ABSTRACT

The present invention relates to an ultrahigh-strength steel sheet and a manufacturing method therefor. More specifically, the present invention can provide an ultra-high strength steel sheet which can ensure weldability and a delayed fracture resistance property by controlling the contents of elements affecting platability along with the contents of austenite-stabilizing elements and increasing twin formation through re-rolling, and simultaneously improve impact characteristics and workability by ensuring excellent yield strength and ductility.

11 Claims, 4 Drawing Sheets

(51) Int. Cl.

| | |
|---|---|
| ***C21D 8/02*** | (2006.01) |
| ***C22C 38/58*** | (2006.01) |
| ***C22C 38/02*** | (2006.01) |
| ***C22C 38/04*** | (2006.01) |
| ***C22C 38/06*** | (2006.01) |
| ***C22C 38/54*** | (2006.01) |
| ***C21D 6/00*** | (2006.01) |
| ***B21B 3/02*** | (2006.01) |
| ***C22C 38/50*** | (2006.01) |
| ***C22C 38/40*** | (2006.01) |

(52) U.S. Cl.

CPC ..... *C21D 8/02* (2013.01); *C21D 8/0205* (2013.01); *C21D 8/0226* (2013.01); *C21D 8/0236* (2013.01); *C21D 8/0263* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/40* (2013.01); *C22C 38/50* (2013.01); *C22C 38/54* (2013.01); *C22C 38/58* (2013.01); *C21D 2211/001* (2013.01)

(56) References Cited

U.S. PATENT DOCUMENTS

| | | | |
|---|---|---|---|
| 2006/0179638 | A1 | 8/2006 | Engl et al. |
| 2009/0074605 | A1 | 3/2009 | Kim et al. |
| 2009/0202382 | A1 | 8/2009 | Kim et al. |
| 2013/0209831 | A1 | 8/2013 | Becker et al. |
| 2014/0209216 | A1 | 7/2014 | Chin et al. |
| 2014/0308156 | A1 | 10/2014 | Oh et al. |
| 2016/0186285 | A1* | 6/2016 | Kim ..... B21B 3/00 148/603 |

FOREIGN PATENT DOCUMENTS

| | | | |
|---|---|---|---|
| EP | 0 573 641 | A1 | 12/1993 |
| EP | 2090668 | A1 | 8/2009 |
| EP | 2402472 | A1 | 1/2012 |
| JP | 58-126956 | A | 7/1983 |
| JP | 58-185755 | A | 10/1983 |
| JP | 4-259325 | A | 9/1992 |
| JP | 2006-509912 | A | 3/2006 |
| JP | 2006-528278 | A | 12/2006 |
| JP | 2009-521602 | A | 6/2009 |
| JP | 2009-545676 | A | 12/2009 |
| JP | 2010-106313 | A | 5/2010 |
| JP | 2011-111666 | A | 6/2011 |
| JP | 05-195156 | B2 | 5/2013 |
| KR | 95-26569 | A | 10/1995 |
| KR | 10-2007-0067950 | A | 6/2007 |
| KR | 10-0742823 | B1 | 7/2007 |
| KR | 10-2007-0094871 | A | 9/2007 |
| KR | 10-2008-0060982 | A | 7/2008 |
| KR | 10-0851158 | B1 | 8/2008 |
| KR | 10-2009-0070502 | A | 7/2009 |
| KR | 2009-0070504 | A | 7/2009 |
| KR | 2010-0071619 | A | 6/2010 |
| KR | 10-2012-0041540 | A | 5/2012 |
| KR | 10-2013-0050138 | A | 5/2013 |
| KR | 2013-0068403 | A | 6/2013 |
| KR | 10-2013-0073737 | A | 7/2013 |
| WO | 93/13233 | A1 | 7/1993 |
| WO | 02/101109 | A1 | 12/2002 |
| WO | 2007/075006 | A1 | 7/2007 |
| WO | 2008/078940 | A1 | 7/2008 |
| WO | 2009/084793 | A1 | 7/2009 |
| WO | 2010/052751 | A1 | 5/2010 |
| WO | 2013/032173 | A2 | 3/2013 |
| WO | 2013/069937 | A1 | 5/2013 |

OTHER PUBLICATIONS

European Search Report issued in European Application No. 13891437.9, dated Jul. 11, 2016.

Chinese Office Action dated Oct. 20, 2016 issued in Chinese Patent Application No. 201380078894.X.

European Search Report issued in European Application No. 17180957.7, dated Sep. 26, 2017.

Japanese Office Action dated Mar. 14, 2017 issued in Japanese Patent Application No. 2016-534517 (with English translation).

* cited by examiner

【Figure 1】
MICROSTRUCTURE OF INVENTIVE STEEL
BEFORE RE-ROLLING:
ASPECT RATIO = ABOUT 1
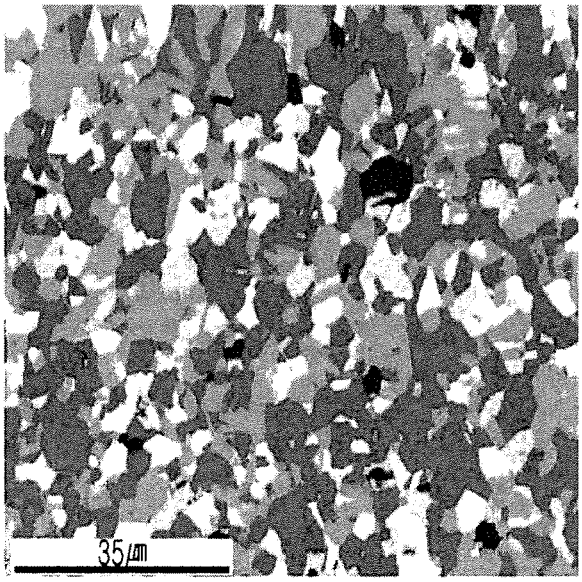
MICROSTRUCTURE OF INVENTIVE STEEL
AFTER RE-ROLLING:
ASPECT RATIO > 2
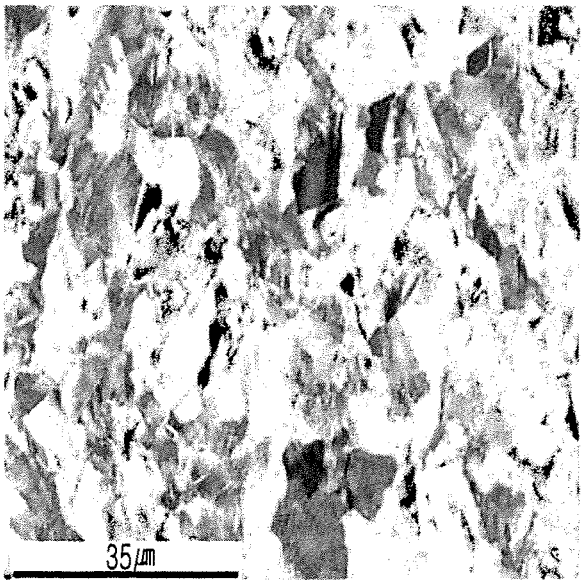

【Figure 2】
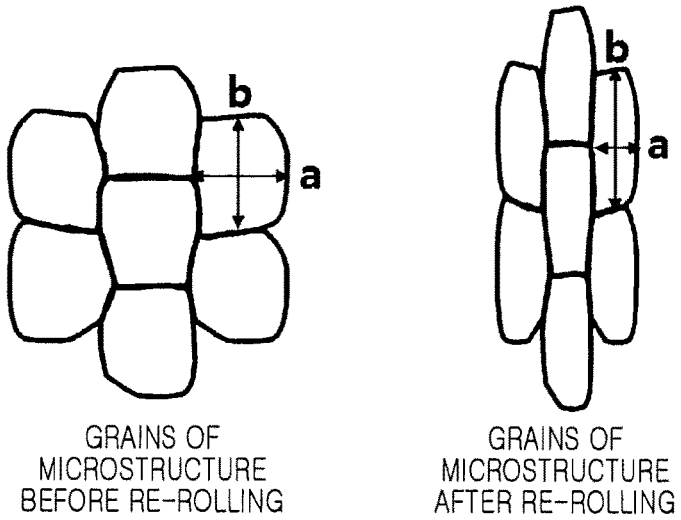
【Figure 3】
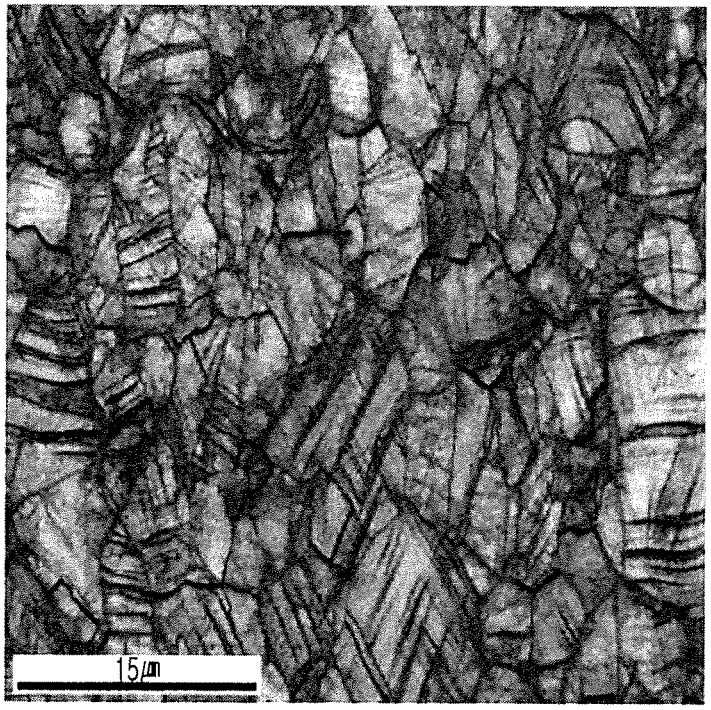

【Figure 4】
MICROSTRUCTURE OF
INVENTIVE STEEL BEFORE RE-ROLLING:
GRAIN SIZE 10 ㎛
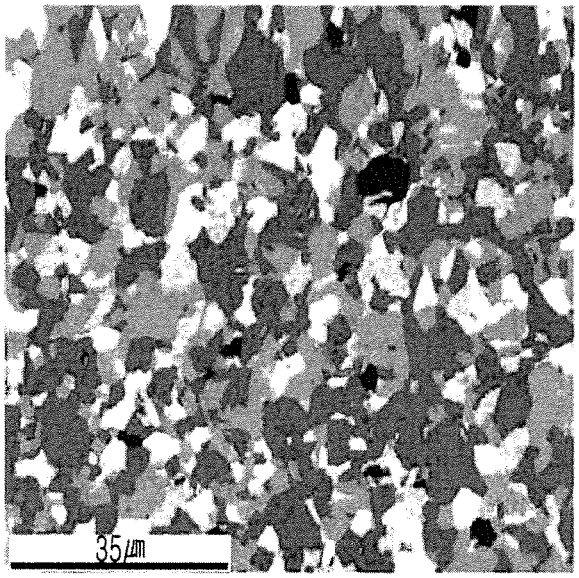
MICROSTRUCTURE OF
INVENTIVE STEEL AFTER RE-ROLLING:
GRAIN SIZE 5 ㎛
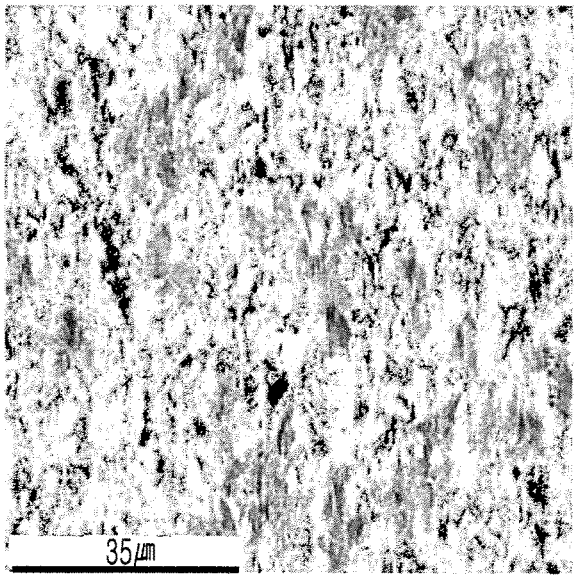

【Figure 5】
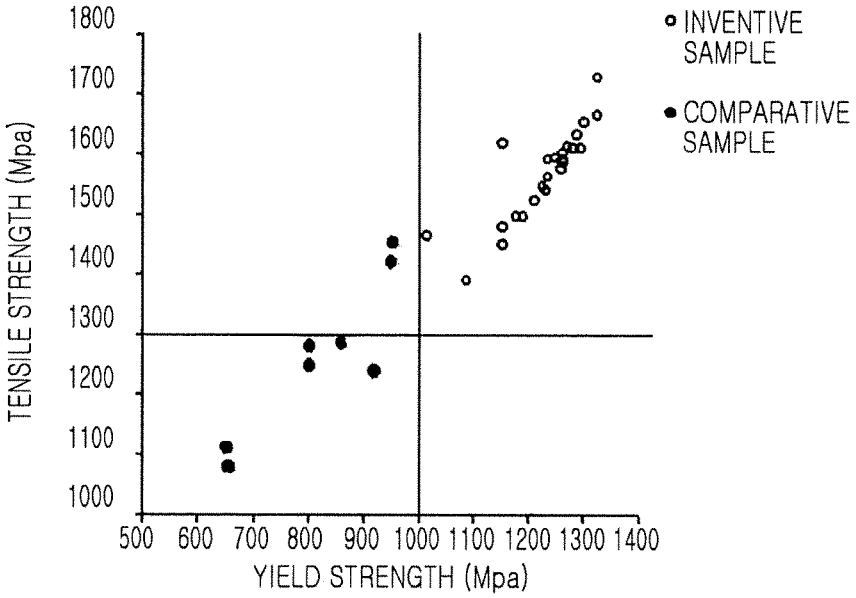

ULTRAHIGH-STRENGTH STEEL SHEET AND MANUFACTURING METHOD THEREFOR

RELATED APPLICATIONS

This application is the U.S. National Phase under 35 U.S.C. § 371 of International Application No. PCT/KR2013/007350, filed on Aug. 14, 2013, the disclosure of which application is incorporated by reference herein.

TECHNICAL FIELD

The present disclosure relates to an ultrahigh-strength steel sheet and a method for manufacturing the ultrahigh-strength steel sheet.

BACKGROUND ART

Recently, automobile manufacturers have increasingly used lightweight, high-strength materials as materials for automobiles to prevent environmental pollution and improve the fuel efficiency and safety of automobiles, and such lightweight and high-strength materials have also been used as materials for automotive structural members.

In the related art, high-strength steel sheets formed of low carbon steel having a ferrite matrix have been used as steel sheets for automobiles. Although low-carbon, high-strength steel sheets are used to manufacture automobiles, it has been difficult to obtain commercially-viable low-carbon, high-strength steel sheets having a maximum elongation of 30% or greater if the low-carbon, high-strength steel sheets have a tensile strength of about 800 MPa or greater. Therefore, it is difficult to use high-strength steel sheets having a strength of about 800 MPa or greater for manufacturing complex components. That is, the use of such high-strength steel sheets only allows for the manufacturing of simple components and makes it difficult to manufacture freely designed components.

In addition, when current steel sheet manufacturing techniques are considered, it is difficult to manufacture steel sheets having a high degree of strength on the level of 1300 Mpa or greater and processable through a cold pressing process or a roll forming process.

Patent Documents 1 and 2 have proposed methods for solving the above-mentioned problems. Patent Documents 1 and 2 disclose high-manganese austenitic steels having high degrees of ductility and strength.

In Patent Document 1, a large amount of manganese (Mn) is added to steel to obtain a steel sheet having a high degree of ductility. However, work hardening occurs severely in deformed portions of the steel sheet, and thus the steel sheet is easily fractured after being worked. In addition, although Patent Document 2 provides a steel sheet having an intended degree of ductility, the characteristics of the steel sheet for electroplating and hot dip plating are poor because of the addition of a large amount of silicon (Si). Furthermore, although Patent Documents 1 and 2 provide steel sheets having high degrees of workability, the yield strength of the steel sheets is low, and thus the crashworthiness of the steel sheets is poor. Moreover, since the steel sheet disclosed in Patent Document 2 has poor weldability in three-sheet lap welding, poor delayed fracture resistance, and a degree of strength on the level of 1200 MPa or less, the marketability of the steel sheet was low, and the steel sheet was not successfully commercialized.

In addition, automobile manufactures have recently increased the use of twining-induced plasticity (TWIP) steel because the formation of twins in high-manganese steel during plastic deformation increases the work hardening of high-manganese steel and thus the formability of high-manganese steel.

However, there is a limit to increasing the tensile strength of TWIP steel containing austenite, and thus it is difficult to manufacture a ultrahigh-strength steel sheet using TWIP steel.

(Patent Document 1) Japanese Patent Application Laid-open Publication No.: 1992-259325

(Patent Document 2) International Patent Publication No.: WO02/101109

DISCLOSURE

Technical Problem

An aspect of the present disclosure may provide a technique for manufacturing an ultrahigh-strength steel sheet having an ultrahigh degree of strength, a high degree of ductility, a high degree of crashworthiness, and a high degree of three-sheet spot weldability by controlling the contents of austenite stabilizing elements and manufacturing conditions so that the ultrahigh-strength steel sheet may be used for manufacturing automotive structural members of vehicle bodies and complex internal plates owing to high workability such as bendability.

Technical Solution

According to an aspect of the present disclosure, an ultrahigh-strength steel sheet may include, by wt %, carbon (C): 0.4% to 0.7%, manganese (Mn): 12% to 24%, aluminum (Al): 0.01% to 3.0%, silicon (Si): 0.3% or less, phosphorus (P): 0.03% or less, sulfur (S): 0.03% or less, nitrogen (N): 0.04% or less, and a balance of iron (Fe) and inevitable impurities, wherein the ultrahigh-strength steel sheet may include single phase austenite as a microstructure.

According to another aspect of the present disclosure, a method for manufacturing an ultrahigh-strength steel sheet may include: heating a steel ingot or a continuously cast slab having the above-described composition to 1050° C. to 1300° C. for homogenization; hot rolling the homogenized steel ingot or continuously cast slab at a finish hot rolling temperature of 850° C. to 1000° C. so as to form a hot-rolled steel sheet; coiling the hot-rolled steel sheet within a temperature range of 200° C. to 700° C.; cold rolling the coiled steel sheet at a reduction ratio of 30% to 80% to form a cold-rolled steel sheet; continuously annealing the cold-rolled steel sheet within a temperature range of 400° C. to 900° C.; and re-rolling the continuously annealed steel sheet.

Advantageous Effects

According to the present disclosure, an ultrahigh-strength steel sheet having high degrees of strength and ductility may be provided by controlling types of alloying elements and contents of the elements, and performing a re-rolling process after a cold rolling process or a plating process so as to induce work hardening and thus to impart tensile strength on the level of 1300 MPa or greater and yield strength on the level of 1000 MPa to the steel sheet. The ultrahigh-strength steel sheet may be used for manufacturing front side members of vehicles as well as automotive structural members of vehicle bodies or complex internal plates.

DESCRIPTION OF DRAWINGS

FIG. 1 is a view illustrating the aspect ratio of grains of a microstructure of inventive steel 5 of Table 1 in a rolling direction before and after a re-rolling process according to an exemplary embodiment of the pressure difference.

FIG. 2 is a schematic view illustrating the definition of an aspect ratio of grains of a microstructure in a rolling direction.

FIG. 3 is a view illustrating grains of a microstructure of inventive steel 5 of Table 3 after a re-rolling process according to an exemplary embodiment of the pressure difference.

FIG. 4 is a view illustrating the average grain size of a microstructure of inventive steel 7 of Table 5 before and after a re-rolling process according to an exemplary embodiment of the pressure difference.

FIG. 5 is a graph illustrating the tensile strength and yield strength of inventive samples and comparative samples of Table 7.

BEST MODE

The inventors have conducted research to improve high manganese steel having a high degree of strength owing to containing a large amount of manganese (Mn) but a low degree of ductility and thus a low degree of formability. As a result, the inventors have found that an ultrahigh-strength steel sheet having high degrees of strength, ductility, and workability for manufacturing automotive components could be manufactured by controlling alloying elements and inducing work hardening through a re-rolling process.

In addition, the inventors have found that if types and contents of alloying elements in steel are optimally adjusted, a steel sheet having high degrees of crashworthiness, platability, and three-sheet weldability could be manufactured. Based on this knowledge, the inventors have invented the present invention.

The present disclosure relates to an ultrahigh-strength steel sheet. The contents of alloying elements, that is, the contents of austenite stabilizing elements such as manganese (Mn), carbon (C), and aluminum (Al) in the ultrahigh-strength steel sheet are adjusted so as to guarantee the formation of intact austenite at room temperature and to optimize the formation of deformation twins during a plastic deformation. In addition, the ultrahigh-strength steel sheet is processed through a re-rolling process so as to improve the strength of the steel sheet and control the microstructure of the steel sheet for improving the workability, crashworthiness, platability, and weldability of the steel sheet.

Embodiments of the present disclosure will now be described in detail.

First, reasons for regulating the contents of alloying elements of the ultrahigh-strength steel sheet will be described according to an exemplary embodiment of the present disclosure. In the following description, the content of each element is in wt % unless otherwise specified.

Carbon (C): 0.4% to 0.7%

Since carbon (C) is an element stabilizing austenite, as the content of carbon (C) increases, the formation of austenite is facilitated. However, if the content of carbon (C) in steel is less than 0.4%, when the steel is deformed, α'-martensite is formed, causing cracks in a working process and decreases the ductility of the steel. Conversely, if the content of carbon (C) in steel is greater than 0.7%, the electrical resistance of the steel may increase, and thus the weldability of the steel may decrease when a spot welding process using electrical resistance is performed on three sheets of the steel. Therefore, according to the exemplary embodiment of the present disclosure, it may be preferable that the content of carbon (C) be within the range of 0.4% to 0.7%.

Manganese (Mn): 12% to 24%

Like carbon (C), manganese (Mn) is an element stabilizing austenite. However, if the content of manganese (Mn) in steel is less than 12%, α'-martensite, decreasing the formability of the steel, is formed, and thus even though the strength of the steel is increased, the ductility of the steel is markedly decreased. In addition, the work hardening of the steel is decreased. Conversely, if the content of manganese (Mn) is greater than 24%, the strength of the steel is increased because the formation of twins is suppressed. However, the ductility of the steel is decreased, and the electrical resistance of the steel is increased to result in poor weldability. Moreover, as the content of manganese (Mn) in steel increases, cracks may be easily formed during a hot rolling process, and in terms of economics, the manufacturing costs of steel are increased. Therefore, according to the exemplary embodiment of the present disclosure, it may be preferable that the content of manganese (Mn) be within the range of 12% to 24%.

Aluminum (Al): 0.01% to 3.0%

In general, aluminum (Al) is added to steel as a deoxidizer. In the exemplary embodiment of the present disclosure, however, aluminum (Al) is added to the steel sheet to improve ductility and delayed fracture resistance. That is, although aluminum (Al) stabilizes ferrite, aluminum (Al) increases stacking fault energy on a slip plane, thereby suppressing the formation of ε-martensite and improving the ductility and delayed fracture resistance of steel. In addition, although the content of manganese (Mn) is low, aluminum (Al) suppresses the formation of ε-martensite, and thus the addition of aluminum (Al) has an effect of improving the workability of steel while minimizing the addition of manganese (Mn). Therefore, if the content of aluminum (Al) in steel is less than 0.01%, although the strength of the steel is increased owing to the formation of ε-martensite, the ductility of the steel is markedly decreased. Conversely, if the content of aluminum (Al) in steel is greater than 3.0%, the formation of twins is suppressed, and thus the ductility of the steel is decreased. In addition, the castability of the steel is lowered in a continuous casting process, and when the steel is hot-rolled to form a steel sheet, the surface of the steel sheet is easily oxidized, thereby decreasing the surface qualities of the steel sheet. Therefore, according to the exemplary embodiment of the present disclosure, it may be preferable that the content of aluminum (Al) be within the range of 0.01% to 3.0%.

Silicon (Si): 0.3% or Less

Silicon (Si) is an element promoting solid-solution strengthening. When dissolved in steel, silicon (Si) decreases the grain size of the steel and thus increases the yield strength of the steel. It is known that if the content of silicon (Si) in steel is excessive, the hot-dip platability of the steel deteriorates because a silicon oxide layer is formed on the surface of the steel.

However, if a proper amount of silicon (Si) is added to steel containing a large amount of manganese (Mn), the oxidation of manganese (Mn) is suppressed owing to containing a thin silicon oxide layer formed on the surface of the steel. Therefore, the formation of a thick manganese oxide layer on a cold-rolled steel sheet may be prevented after a rolling process, and the corrosion of the cold-rolled steel sheet may be prevented after an annealing process, thereby improving the surface qualities of the cold-rolled steel sheet and maintaining the surface qualities of the cold-rolled steel sheet in an electroplating process. However, if the content of silicon (Si) in steel is increased by too much, large amounts of silicon oxides may be formed on the surface of a steel sheet in a hot rolling process, and thus the steel sheet may not be easily pickled and may have poor surface qualities. In addition, when a steel sheet is annealed at a high temperature in a continuous annealing process or a continuous hot-dip plating process, silicon (Si) may be concentrated on the surface of the steel sheet. Thus, when the steel sheet is processed through a hot-dip plating process, the steel sheet may not be easily wetted with molten zinc, and thus the platability of the steel sheet may be lowered. Moreover, if a large amount of silicon (Si) is added to steel, the weldability of the steel is decreased. Therefore, to avoid the above-mentioned problems, it may be preferable that the content of silicon (Si) be 0.3% or less.

Phosphorus (P) and Sulfur (S): Each 0.03% or Less

In general, phosphorus (P) and sulfur (S) are inevitably added to steel during manufacturing processes, and thus the contents of phosphorus (P) and sulfur (S) are limited to 0.03% or less, respectively. Particularly, phosphorus (P) inducing segregation decreases the workability of steel, and sulfur (S) forming coarse manganese sulfide (MnS) causes defects such as flange cracks and decreases the hole extension ratio (HER) of steel. Therefore, the contents of phosphorus (P) and sulfur (S) are maintained to be as low as possible.

Nitrogen (N): 0.04% or Less

During solidification, nitrogen (N) contained in austenite grains reacts with aluminum (Al) and precipitates as nitrides, thereby facilitating the formation of twins. That is, nitrogen (N) increases the strength and ductility of a steel sheet during a forming process. However, if the content of nitrogen (N) in steel is greater than 0.04%, nitrides may be excessively precipitated, and thus the hot-rolling characteristics and elongation of the steel are worsened. Therefore, it may be preferable that the content of nitrogen (N) be 0.04% or less.

According to the exemplary embodiment of the present disclosure, in addition to the above-mentioned elements, nickel (Ni), chromium (Cr), and tin (Sn) may be further included in the ultrahigh-strength steel sheet so as to further improve characteristics such as crashworthiness and platability.

Ni: 0.05% to 1.0%

Nickel (Ni) an effective element for stabilizing austenite and increasing the strength of steel sheets. However, if the content of nickel (Ni) is less than 0.05%, it may be difficult to obtain the above-mentioned effects, and if the content of nickel (Ni) is greater than 1.0%, it is uneconomical because manufacturing costs increase. Therefore, according to the exemplary embodiment of the present disclosure, it may be preferable that the content of nickel (Ni) be within the range of 0.05% to 1.0%.

Chromium (Cr): 0.05% to 1.0%

Chromium (Cr) is an effective element for improving the platability and strength of steel sheets. However, if the content of chromium (Cr) is less than 0.05%, it may be difficult to obtain the above-mentioned effects, and if the content of chromium (Cr) is greater than 1.0%, it is uneconomical because manufacturing costs increase. Therefore, according to the exemplary embodiment of the present disclosure, it may be preferable that the content of chromium (Cr) be within the range of 0.05% to 1.0%.

Tin (Sn): 0.01% to 0.1%

Like chromium (Cr), tin (Sn) is an effective element for improving the platability and strength of steel sheets. However, if the content of tin (Sn) is less than 0.01%, it may be difficult to obtain the above-mentioned effects, and if the content of tin (Sn) is greater than 0.1%, it is uneconomical because manufacturing costs increase. Therefore, according to the exemplary embodiment of the present disclosure, it may be preferable that the content of tin (Sn) be within the range of 0.01% to 0.1%.

Furthermore, according to the exemplary embodiment of the present disclosure, titanium (Ti) and boron (B) may be further included in the ultrahigh-strength steel sheet so as to further improve weldability and workability. In this case, one or both of nickel (Ni) and chromium (Cr) may be added to the ultrahigh-strength steel sheet together with titanium (Ti) and boron (B). If one or both of nickel (Ni) and chromium (Cr) are added, the contents thereof may be within the above-mentioned ranges.

Titanium (Ti): 0.005% to 0.10%

Titanium (Ti) is a strong carbide forming element, and since titanium carbide suppresses the growth of grains, titanium (Ti) is effective in grain refinement. If titanium (Ti) is added to steel together with boron (B), high-temperature compounds are formed along columnar crystal boundaries, and thus grain boundary cracks may be prevented. However, if the content of titanium (Ti) is less than 0.005%, it may be difficult to obtain the above-mentioned effects, and if the content of titanium (Ti) is greater than 0.10%, excessive titanium (Ti) may segregate along grain boundaries to cause grain boundary embrittlement or may form excessively coarse precipitates to hinder the growth of grains. Therefore, according to the exemplary embodiment of the present disclosure, it may be preferable that the content of titanium (Ti) be within the range of 0.005% to 0.10%.

Boron (B): 0.0005% to 0.0050%

If boron (B) is added to steel together with titanium (Ti), high-temperature compounds are formed along grain boundaries, and thus the formation of grain boundary cracks is prevented. However, if the content of boron (B) is less than 0.0005%, it may be difficult to obtain the above-mentioned effect, and if the content of boron (B) is greater than 0.0050%, boron compounds may be formed to worsen the platability of steel. Therefore, according to the exemplary embodiment of the present disclosure, it may be preferable that the content of boron (B) be within the range of 0.0005% to 0.0050%.

The ultrahigh-strength steel sheet having the above-mentioned composition may include single phase austenite as a microstructure, and preferably, the microstructure of the ultrahigh-strength steel sheet may include grains in an amount of 70% or greater that have an aspect ratio of 2 or greater in a rolling direction by the effect of work hardening.

If the aspect ratio of the grains of the microstructure is less than 2 in the rolling direction, the ultrahigh-strength steel sheet may not have intended degrees of strength and ductility. That is, since grains deformed by work hardening to have an aspect ratio of 2 or greater are included in the ultrahigh-strength steel sheet in an amount of 70% or greater, the ultrahigh-strength steel sheet may have high degrees of strength and ductility and thus a high degree of crashworthiness.

In addition, the microstructure of the ultrahigh-strength steel sheet of the exemplary embodiment of the present disclosure may preferably have an average grain size of 2

μm to 10 μm. If the average grain size is greater than 10 μm, the ultrahigh-strength steel sheet may not have intended degree of strength and ductility. Although the ultrahigh-strength steel sheet has a higher degree of strength as the average grain size decreases, the lower limit of the average grain size is preferably set to 2 μm because of limitations in processing. More preferably, if the average grain size is within the range of 2 μm to 5 μm, the strength and ductility of the ultrahigh-strength steel sheet may be further improved.

If the composition of the ultrahigh-strength steel sheet is controlled as described above according to the exemplary embodiment of the present disclosure, the range of current in a welding process for the ultrahigh-strength steel sheet may be within the range of 1.0 kA to 1.5 kA.

Among welding techniques, spot welding is a technique of fusing a base metal using heat generated by electrical resistance. If a base metal containing excessive amounts of alloying elements is spot-welded, the electrical resistance of the base metal may unexpectedly increase or vary due to substances such as oxides formed on a contact surface, and thus spot welding conditions may be restricted. In addition, even though welding is performed, welding defects may remain. That is, the weldability of the base metal may be poor. That is, steel containing large amounts of carbon (C) and manganese (Mn) has a low degree of spot weldability because the electrical resistance of the steel is markedly increased by carbon (C) and manganese (Mn). However, according to the exemplary embodiment of the present disclosure, the contents of carbon (C) and manganese (Mn) in the ultrahigh-strength steel sheet are properly adjusted, and thus the range of current in a spot welding process for the ultrahigh-strength steel sheet may be within the range of 1.0 kA to 1.5 kA.

The inventors have invented a method for manufacturing the ultrahigh-strength steel sheet having the above-described composition, and the method will now be described in detail according to an exemplary embodiment of the present disclosure.

According to the exemplary embodiment of the present disclosure, a steel ingot or a continuously cast slab having the above-described elements and element contents within the above-described ranges may be heated for homogenization. Thereafter, the steel ingot or continuously cast slab may be subjected to a hot rolling process and a hot strip coiling process to form a hot-rolled steel sheet. In addition, the hot-rolled steel sheet may be subjected to a cold rolling process and an annealing process to form a cold-rolled steel sheet. In addition, the cold-rolled steel sheet may be subjected to an electrogalvanizing process or a hot-dip galvanizing process. In the present disclosure, the steel ingot or continuously cast slab may be simply referred to as a slab.

Hereinafter, process conditions for manufacturing the steel sheet will be described in detail.

Heating Process (Homogenization): 1050° C. to 1300° C.

In the exemplary embodiment of the present disclosure, when a slab of high manganese steel is heated for homogenization, it may be preferable that the heating temperature be within the range of 1050° C. to 1300° C.

When the slab is heated for homogenization, as the heating temperature increases, the size of grains may increase, and surface oxidation may occur to cause a decrease in strength or a deterioration surface qualities. In addition, a liquid phase layer may be formed along columnar boundaries of the slab, and thus when the slab is hot rolled, cracks may be formed. Therefore, it may be preferable that the upper limit of the heating temperature be 1300° C. Conversely, if the heating temperature is lower than 1050° C., it may be difficult to maintain the slab at a certain temperature in a finish rolling process, and thus the rolling load may increase because of a temperature decrease. That is, the slab may not be sufficiently rolled to an intended thickness. Therefore, it may be preferable that the lower limit of the heating temperature be 1050° C.

Rolling Process: Finish Hot Rolling Temperature 850° C. to 1000° C.

The slab homogenized through the heating process may be subjected to a hot rolling process to form a hot-rolled steel sheet. In this case, preferably, the temperature of finish hot rolling may be set to be within the range of 850° C. to 1000° C.

If the finish hot rolling temperature is lower than 850° C., the rolling load may increase. Thus, a rolling mill may be damaged, and the interior quality of the steel sheet may be worsened. Conversely, if the finish hot rolling temperature is higher than 1000° C., surface oxidation may occur during a rolling process. Therefore, preferably, the finish hot rolling temperature may be set to be within the range of 850° C. to 1000° C., and more preferably within the range of 900° C. to 1000° C.

Coiling Process: 200° C. to 700° C.

The hot-rolled steel sheet may be subjected to a hot strip coiling process. In this case, the coiling temperature of the hot strip coiling process may preferably be 700° C. or lower.

If the coiling temperature of the hot strip coiling process is higher than 700° C., a thick oxide layer may be formed on the surface of the hot-rolled steel sheet, and oxidation may occur inside the hot-rolled steel sheet. In this case, the oxide layer may not be easily removed in a pickling process. Thus, the coiling temperature may preferably be 700° C. or lower. However, to adjust the coiling temperature to be lower than 200° C., it may be necessary to spray a large amount of cooling water on the hot-rolled steel after the hot rolling process. In this case, coiling may not smoothly proceed, and workability may decrease. Therefore, it may be preferable that the lower limit of the coiling temperature be 200° C.

Cold Rolling Process: Reduction Ratio 30% to 80%

After performing the hot rolling process under the above-mentioned conditions, a cold rolling process may be performed under general conditions so as to form a cold-rolled steel sheet having an intended shape and thickness. In this case, the reduction ratio of the cold rolling process may be set according to customer requirements. For example, preferably, the reduction ratio may be set to be within the range of 30% to 80% so as to adjust the strength and elongation of the steel sheet.

Continuous Annealing Process: 400° C. to 900° C.

The cold-rolled steel sheet may be subjected to a continuous annealing process. In this case, the temperature of the continuous annealing process may preferably be within the range of 400° C. to 900° C., and then the platability and strength of the cold-rolled steel sheet may be improved.

In detail, if the temperature of the continuous annealing process is too low, the workability of the cold-rolled steel sheet may not be sufficiently improved, and transformation into austenite may not sufficiently occur such that austenite may not be maintained at a low temperature. Therefore, preferably, the temperature of the continuous annealing process may be 400° C. or higher. However, if the temperature of the continuous annealing process is too high, recrystallization may excessively occur, or the strength of the steel sheet may be decreased to 1000 MPa or less because of the growth of grains. Particularly, large amounts of surface oxides may be formed on the steel sheet in a hot-dip plating process, and thus the platability of the steel sheet may deteriorate. Therefore, the upper limit of the temperature of the continuous annealing process may be set to be 900° C.

In the exemplary embodiment of the present disclosure, since the high manganese steel is austenitic steel not undergoing phase transformation, if the high manganese steel is heated to its recrystallization temperature or higher, the workability of the high manganese steel may be sufficiently improved. Therefore, general annealing conditions may be used.

A hot-dip plated steel sheet, an electroplated steel sheet, or an hot-dip alloy plated steel sheet may be manufactured by immersing the cold-rolled steel sheet manufactured under the above-described conditions into a plating bath, or performing an electroplating process or a hot-dip alloy plating process on the cold-rolled steel sheet.

The electroplated steel sheet may be manufactured using a general electroplating method and conditions. In addition, the hot-dip alloy plated steel sheet may be manufactured by performing a general hot-dip alloy plating process on the cold-rolled steel sheet after the continuous annealing process.

Generally, in an electroplating process or a hot-dip alloy plating process, heat treatment conditions have an effect on steel undergoing phase transformations, and thus proper heat treatment conditions may be required. According to the exemplary embodiment of the present disclosure, however, the high manganese steel has single phase austenite and does not undergo phase transformation, and thus the mechanical characteristics of the high manganese steel may be markedly independent on heat treatment Therefore, the steel sheet may be plated under general conditions.

The steel sheet manufactured as described above, such as the cold-rolled steel sheet, the hot-dip plated steel sheet, the hot-dip alloy plated steel sheet, or the electroplated steel sheet, may be re-rolled through one of a skin pass milling process, a double reduction rolling process, a hot rolling finishing process, and a continuous rolling process so as to increase the strength of the steel sheet by work hardening.

At this time, the reduction ratio of the re-rolling process may preferably be 30% or greater so as to efficiently improve the tensile strength of the steel sheet while not markedly increasing the rolling load. More preferably, the reduction ratio of the re-rolling process may be within the range of 30% to 50%.

Referring to FIG. 1, the microstructure of the steel sheet varied by the re-rolling process was observed by Electron Backscattered Diffraction (EBSD). Before the re-rolling process, the aspect ratio of grains of the steel sheet in the rolling direction was less than about 1. However, after the re-rolling process, the aspect ratio of grains of the steel sheet in the rolling direction was 2 or greater, and the amount of such grains was 70% or more. In addition, the faction of twins was also increased. Therefore, according to the exemplary embodiment of the present disclosure, the high manganese steel could have an ultrahigh degree of strength and a high degree of crashworthiness through the re-rolling process. In other words, it may be preferable that grains having an aspect ratio of 2 or greater in the rolling direction after the re-rolling process be included in the steel sheet in an amount of 70% or greater.

Herein, the term "aspect ratio" refers to a ratio of the height (b) to the width (a) of grains as shown in FIG. 2.

In addition, FIG. 4 illustrates the grain size of the steel sheet before and after the re-rolling process. Before the re-rolling process, the steel sheet had an average grain size of about 10 μm, and after the re-rolling process, the steel sheet had an average grain size of about 5 μm and an increase twin fraction.

In general, if steel is deformed by cold rolling or tension, grains of the steel are stretched in the deformation direction of the steel. However, if high manganese twinning-induced plasticity (TWIP) steel is deformed, twins are formed in the steel as well as grains of the steel being stretched. In the grains of the steel, the twins form a new grain orientation and induce grain refinement. That is, the re-rolling process induces grain refinement and thus guarantees ultrahigh strength. According to the exemplary embodiment of the present disclosure, after the re-rolling process, the microstructure of the steel sheet may preferably have an average grain size of 2 μm to 10 μm and thus have ultrahigh strength.

Unlike corrosion resistance of a plating layer, crashworthiness relates to the mechanical characteristics of an internal primary phase of a metal, and heat treatment conditions for plating high manganese steel having single phase austenite do not have an effect on the mechanical characteristics of the high manganese steel. Therefore, the steel sheet of the exemplary embodiment of the present disclosure may have crashworthiness after being plated.

As described above, the steel sheet having elements and contents of the elements and conditions for manufacturing as described in the exemplary embodiment of the present disclosure may have an ultrahigh degree of strength within the range of 1300 MPa or greater and a high degree of yield strength within the range of 1000 MPa or greater.

That is, according to the exemplary embodiment of the present disclosure, the steel sheet may have a high degree of ductility as well as a high degree of strength, and thus the workability of the steel sheet may be satisfactory in a forming process.

Hereinafter, the present disclosure will be described more specifically according to examples. However, the examples are provided for clearly explaining the embodiments of the present disclosure and are not intended to limit the scope of the present invention.

MODE FOR INVENTION

Example 1

Steel ingots having compositions as illustrated in Table 1 were maintained in a heating furnace at 1200° C. for one hour and were subjected to a hot rolling process to form hot-rolled steel sheets. At that time, the temperature of finish hot rolling was set to be 900° C., and after the hot rolling process, the hot-rolled steel sheets were coiled at 650° C. Thereafter, the hot-rolled steel sheets were pickled and were cold rolled at a reduction ratio of 50%. Next, samples of the cold-rolled steel sheets were heat treated at an annealing temperature of 800° C. and an overaging temperature of 400° C. to simulate a continuous annealing process, and were then re-rolled with reduction ratios as illustrated in Table 2 below.

After the cold-rolled steel sheets were re-rolled, a tension test was performed to measure mechanical characteristics of the re-rolled steel sheets such as strength and elongation according to reduction ratios, and results of the tension test are illustrated in Table 2. The tension test was performed on samples prepared from the re-rolled steel sheets according to JIS 5 by using a universal testing machine.

TABLE 1

| Samples | C | Al | Mn | P | S | Si | N | Note |
|---|---|---|---|---|---|---|---|---|
| 1 | 0.35 | 1.48 | 11.50 | 0.01 | 0.01 | 0.01 | 0.0080 | Comparative Steel |
| 2 | 0.59 | 0.00 | 14.92 | 0.02 | 0.01 | 0.01 | 0.0080 | Comparative Steel |
| 3 | 0.55 | 1.55 | 15.27 | 0.01 | 0.01 | 0.01 | 0.0071 | Inventive Steel |
| 4 | 0.58 | 1.81 | 15.13 | 0.01 | 0.01 | 0.01 | 0.0082 | Inventive Steel |
| 5 | 0.59 | 2.02 | 15.18 | 0.01 | 0.00 | 0.01 | 0.0077 | Inventive Steel |
| 6 | 0.60 | 0.05 | 25.00 | 0.01 | 0.01 | 0.06 | 0.0068 | Comparative Steel |

TABLE 2

| Steels | Reduction (%) in re-rolling | YS (MPa) | TS (MPa) | T-El (%) | Note |
|---|---|---|---|---|---|
| 1-1 | 20.1 | 654.9 | 1078.6 | 40.1 | Comparative Sample |
| 1-2 | 29.9 | 802.1 | 1249.5 | 31.2 | Comparative Sample |
| 1-3 | 39.7 | 949.3 | 1420.3 | 22.3 | Comparative Sample |
| 2-1 | 15.1 | 614.0 | 980.0 | 42.2 | Comparative Sample |
| 2-2 | 30.9 | 824.0 | 1130.0 | 6.3 | Comparative Sample |
| 3-1 | 37.3 | 1250.0 | 1596.0 | 11.2 | Inventive Sample |
| 4-1 | 37.6 | 1261.0 | 1587.0 | 11.6 | Inventive Sample |
| 5-1 | 36.4 | 1260.0 | 1604.0 | 10.9 | Inventive Sample |
| 5-2 | 36.4 | 1226.0 | 1546.0 | 8.7 | Inventive Sample |
| 5-3 | 40.8 | 1271.0 | 1615.0 | 10.4 | Inventive Sample |
| 5-4 | 43.4 | 1287.0 | 1633.0 | 10.3 | Inventive Sample |
| 6-1 | 19.9 | 651.9 | 1111.9 | 27.2 | Comparative Sample |
| 6-2 | 27.8 | 800.6 | 1281.0 | 18.4 | Comparative Sample |
| 6-3 | 39.9 | 952.3 | 1453.6 | 5.4 | Comparative Sample |

Table 2 illustrates results of an evaluation of the strength of the steel sheets which were prepared from the steel ingots having the compositions shown in Table 1 through the hot rolling process, the cold rolling process, and the re-rolling process inducing work hardening. In Table 2, steel sheets having high degrees of tensile strength, yield strength, and elongation according to the reduction ratios in the re-rolling process are inventive samples.

As illustrated in Table 2, the contents of carbon (C) and manganese (Mn) in steels 1-1 to 1-3 prepared using sample 1 of Table 1 were lower than the ranges proposed in the present disclosure, and thus the yield strength and tensile strength of steels 1-1 and 1-3 were low. Particularly, steels 1-1 and 1-2 re-rolled at a reduction ratio of less than 30% had lower yield strength and tensile strength than steel 1-3 re-rolled at a reduction ratio of 30% or greater.

In addition, steels 2-1 and 2-2 prepared using sample 2 of Table 1 not including aluminum (Al) had low degrees of yield strength and tensile strength. Similarly, steel 2-1 re-rolled at a reduction ratio of less than 30% had yield strength and tensile strength lower than those of steel 2-2 re-rolled at a reduction ratio of 30% or greater.

The contents of manganese (Mn) and silicon (Si) in steels 6-1 to 6-3 prepared using sample 6 of Table 1 were outside the ranges proposed in the present disclosure, and thus the yield strength of steels 6-1 to 6-3 was low. In addition, steels 6-1 and 6-2 re-rolled at a reduction ratio of less than 30% had yield strength and tensile strength lower than those of steel 6-3 re-rolled at a reduction ratio of 30% or greater.

Therefore, it can be understood that when a re-rolling process is performed at a reduction ratio of 30% or greater, high degrees of yield strength and tensile strength are guaranteed.

However, samples (steels 3-1 to 5-4) having compositions as proposed in the present disclosure had high degrees of yield strength and tensile strength.

Along with this, so as to evaluate the effect of the re-rolling process on the microstructure of steel and the yield strength and tensile strength of the steel, the microstructure of inventive steel 5 was observed by electron backscattered diffraction (EBSD) before and after the re-rolling process, as illustrated in FIG. 1.

As shown in FIG. 1, before the re-rolling process, the aspect ratio of grains of inventive steel 5 in the rolling direction was about 1. However, after the re-rolling process, the aspect ratio of grains of inventive steel 5 in the rolling direction was 2 or greater, and the amount of such grains was 70% or more. In addition, the twin faction of inventive steel 5 was also increased owing to the re-rolling process. As described above, it may be understood that since a re-rolling process increases the aspect ratio of grains of steel in the rolling direction and the formation of twins in the steel, the yield strength and tensile strength of the steel were increased. Thus, the yield strength and tensile strength of other inventive samples were also increased after the re-rolling process, and thus had a high degree of crashworthiness.

Therefore, the high manganese steel of the present disclosure may have an ultrahigh degree of strength and a high degree of crashworthiness through the re-rolling process.

Example 2

Steel ingots having compositions as illustrated in Table 3 were maintained in a heating furnace at 1200° C. for one hour and were subjected to a hot rolling process to form hot-rolled steel sheets. At that time, the temperature of finish hot rolling was set to be 900° C., and after the hot rolling process, the hot-rolled steel sheets were coiled at 650° C. Thereafter, the hot-rolled steel sheets were pickled and were cold rolled at a reduction ratio of 50%. Next, samples of the cold-rolled steel sheets were heat treated (continuously annealed) at an annealing temperature of 800° C. and an overaging temperature of 400° C. to simulate a continuous annealing process. In addition, after the cold-rolled steel sheets were heat treated as described above, a test for simulating a hot-dip galvanizing process was performed on the steel sheets using a hot-dip galvanizing bath adjusted to a temperature of 460° C. In addition, as described in the above example, the continuously annealed steel sheets were re-rolled with different reduction ratios as illustrated in Table 4 below.

The platability of the hot-dip galvanized steel sheets was measured as illustrated in Table 4. In detail, the steel sheets were hot-dip galvanized by setting the temperature of the hot-dip galvanizing bath to be 460° C. and immersing the steel sheets into the hot-dip galvanizing bath. Thereafter, the platability of the hot-dip galvanized steel sheets was evaluated by observing the appearance of the hot-dip galvanized steel sheets with the naked eye. A steel sheet with a uniform plating layer was evaluated as being "good", and a steel sheet with a non-uniform plating layer was evaluated as being "poor" as illustrated in Table 4.

In addition, after the cold-rolled steel sheets were re-rolled, a tension test were performed to measure mechanical characteristics of the cold-rolled steel sheets such as strength and elongation according to reduction ratios, and results of the tension test were illustrated in Table 4. The tension test was performed on samples prepared from the re-rolled steel sheets according to JIS 5 by using a universal testing machine.

TABLE 3

| Samples | C | Al | Mn | P | S | Si | Ni | Cr | Sn | N | Note |
|---|---|---|---|---|---|---|---|---|---|---|---|
| 1 | 0.35 | 1.48 | 12.00 | 0.01 | 0.01 | 0.01 | 0.255 | 0.31 | 0.03 | 0.0080 | Comparative Steel |
| 2 | 0.59 | 0.00 | 14.92 | 0.02 | 0.01 | 0.01 | 0.004 | 0.30 | 0.00 | 0.0080 | Comparative Steel |
| 3 | 0.75 | 1.01 | 15.24 | 0.02 | 0.01 | 0.01 | 0.004 | 0.31 | 0.00 | 0.0088 | Comparative Steel |
| 4 | 0.59 | 2.02 | 15.18 | 0.01 | 0.00 | 0.01 | 0.009 | 0.31 | 0.00 | 0.0077 | Comparative Steel |
| 5 | 0.51 | 1.31 | 15.42 | 0.02 | 0.01 | 0.01 | 0.255 | 0.31 | 0.03 | 0.0078 | Inventive Steel |
| 6 | 0.50 | 1.79 | 15.23 | 0.01 | 0.00 | 0.01 | 0.253 | 0.31 | 0.03 | 0.0083 | Inventive Steel |
| 7 | 0.62 | 1.60 | 18.20 | 0.01 | 0.01 | 0.01 | 0.210 | 0.20 | 0.03 | 0.0078 | Inventive Steel |
| 8 | 0.60 | 0.05 | 24.00 | 0.01 | 0.01 | 0.06 | — | — | — | 0.0068 | Comparative Steel |

TABLE 4

| Steels | Platability | Reduction | YS | TS | T-El | Note |
|---|---|---|---|---|---|---|
| 1-1 | Good | 20.1 | 654.9 | 1078.6 | 40.1 | Comparative Sample |
| 1-2 | Good | 29.9 | 802.1 | 1249.5 | 31.2 | Comparative Sample |
| 1-3 | Good | 39.7 | 949.3 | 1420.3 | 22.3 | Comparative Sample |
| 2-1 | Poor | 20.1 | 1154.0 | 1480.0 | 16.2 | Comparative Sample |
| 2-2 | Poor | 30.9 | 1324.0 | 1730.0 | 6.3 | Comparative Sample |
| 3-1 | Poor | 34.5 | 1300.0 | 1655.0 | 12.4 | Comparative Sample |
| 4-1 | Poor | 36.4 | 1260.0 | 1604.0 | 10.9 | Comparative Sample |
| 4-2 | Poor | 36.4 | 1226.0 | 1546.0 | 8.7 | Comparative Sample |
| 4-3 | Poor | 40.8 | 1271.0 | 1615.0 | 10.4 | Comparative Sample |
| 4-4 | Poor | 43.4 | 1287.0 | 1633.0 | 10.3 | Comparative Sample |
| 5-1 | Good | 32.4 | 1178.0 | 1498.0 | 11.8 | Inventive Sample |
| 5-2 | Good | 36.9 | 1233.0 | 1563.0 | 10.3 | Inventive Sample |
| 5-3 | Good | 38.2 | 1262.0 | 1594.0 | 10.0 | Inventive Sample |
| 5-4 | Good | 41.9 | 1325.0 | 1666.0 | 9.3 | Inventive Sample |
| 6-1 | Good | 18.0 | 918.0 | 1240.0 | 20.2 | Comparative Sample |
| 6-2 | Good | 30.5 | 1088.0 | 1390.0 | 12.2 | Inventive Sample |
| 6-3 | Good | 36.7 | 1188.0 | 1499.0 | 10.7 | Inventive Sample |
| 6-4 | Good | 39.6 | 1231.0 | 1541.0 | 10.4 | Inventive Sample |
| 6-5 | Good | 44.7 | 1294.0 | 1613.0 | 8.0 | Inventive Sample |
| 7-1 | Good | 20.1 | 858.9 | 1286.3 | 41.5 | Comparative Sample |
| 7-2 | Good | 31.2 | 1004.6 | 1452.0 | 32.8 | Inventive Sample |
| 7-3 | Good | 39.7 | 1153.3 | 1621.2 | 24.0 | Inventive Sample |
| 8-1 | Poor | 19.9 | 651.9 | 1111.9 | 27.2 | Comparative Sample |
| 8-2 | Poor | 29.8 | 800.6 | 1281.0 | 18.4 | Comparative Sample |
| 8-3 | Poor | 39.9 | 952.3 | 1453.6 | 5.4 | Comparative Sample |

The platability evaluation results illustrated in Table 4 were obtained from the cold-rolled steel sheets formed from the steels illustrated in Table 3 before the cold rolled steel sheets were re-rolled after the hot-dip galvanizing simulation test. In addition, after the steel sheets were formed of the steel ingots having compositions as illustrated in Table 3 through the hot rolling process, the cold rolling process, and the re-rolling process for inducting work hardening, the strength of the steel sheets were measured as illustrated in Table 4.

As illustrated in Table 4, the contents of elements having an effect on platability such as nickel (Ni), chromium (Cr), or tin (Sn) in steels 1-1 to 1-3 formed of samples 1 of table 3 were within the ranges proposed in the present disclosure, and thus platability of steels 1-1 to 1-3 were good. However, the content of carbon (C) having an effect on strength was lower than the range proposed in the present disclosure, and thus the tensile strength and yield strength of steels 1-1 to 1-3 were not guaranteed after work hardening. Particularly, when the reduction ratio of the re-rolling process was less than 30%, strength was low compared to the case in which the reduction ratio of the re-rolling process was 30% or greater.

In addition, steels 2-1, 2-2, 3-1, and 4-1 to 4-4 formed of samples 2 to 4 of Table 3 not including tin (Sn) having an effect on platability had a low degree of platability.

Steels 8-1 to 8-3 formed of sample 8 of Table 3 not including any one of nickel (Ni), chromium (Cr), and tin (Sn) having an effect on platability were observed as having very poor platability.

However, steels 5-1 to 5-4, 6-2 to 6-5, 7-2, and 7-3 formed of samples 5-7 having compositions as proposed in the present disclosure had high degrees of yield strength and tensile strength as well as having a high degree of platability. However, steels 6-1 and 7-1 re-rolled at a reduction ratio of less than 30% had not satisfied the degrees of tensile strength and yield strength of the present disclosure. That is, when the reduction ratio of the re-rolling process was increased, for example, to 30% or greater, yield strength and tensile strength were further increased. Therefore, it could be understood that when a re-rolling process is performed at a reduction ratio of 30% or greater, high degrees of yield strength and tensile strength are guaranteed.

Along with this, so as to evaluate the effect of the re-rolling process on the microstructure of steel and the yield strength and tensile strength of the steel, the microstructure of inventive steel 5 was observed by electron backscattered diffraction (EBSD) after the re-rolling process, as illustrated in FIG. 3.

As shown in FIG. 3, after the re-rolling process, the aspect ratio of grains in the rolling direction was 2 or greater, and the amount of such grains was 70% or greater. In addition, many twins were formed.

As described above, it may be understood that since a re-rolling process increases the aspect ratio of grains of steel in the rolling direction and the formation of twins in the steel, the yield strength and tensile strength of the steel are increased. Thus, the yield strength and tensile strength of other inventive samples were also increased after the re-rolling process, and thus had a high degree of crashworthiness.

Therefore, the high manganese steel of the present disclosure may have an ultrahigh degree of strength and a high degree of crashworthiness through the re-rolling process.

Example 3

Steel ingots having compositions as illustrated in Table 5 were maintained in a heating furnace at 1200° C. for one hour and were subjected to a hot rolling process to form hot-rolled steel sheets. At that time, the temperature of finish hot rolling was set to be 900° C., and after the hot rolling process, the hot-rolled steel sheet was coiled at 650° C. Thereafter, the hot-rolled steel sheets were pickled and were cold rolled at a reduction ratio of 50%. Next, samples of the cold-rolled steel sheets were heat treated at an annealing temperature of 800° C. and an overaging temperature of 400° C. to simulate a continuous annealing process. In addition, after the cold-rolled steel sheets were continuously annealed at 800° C. as described above, a test for simulating a hot-dip galvanizing process was performed on the steel sheets using a hot-dip galvanizing bath adjusted to a temperature of 460° C.

Thereafter, tension test samples were prepared from the cold-rolled steel sheets by JIS 5, and a tension test was performed using a universal testing machine. Results of the tension test are illustrated in Table 6.

In addition, a current range for welding three sheets was measured using the cold-rolled steel sheets processed through the heat treatment simulating a continuous annealing process, and the plated steel sheets. In detail, three sheets of each of the steel (twining-induced plasticity (TWIP) steel) of the present disclosure, mild steel, and dual phase (DP) steel were welded together within a set current range according to a standard spot welding test method by ISO. Results of the test are illustrated in Table 6.

In addition, standard cup samples were formed of the cold-rolled steel sheets, and the formation of cracks caused by delayed fracture were checked under salt spray test (SST) conditions. In detail, standard cup samples were prepared through a drawing process with a drawing ratio of 1.8, and time periods until cracks were formed in the cup samples under SST conditions were measured. Cup samples in which cracks were not formed for a reference time period (240 hours) were determined as being "good." Results of the test are shown in Table 6.

In addition, after the cold-rolled steel sheets were re-rolled, a tension test were performed to measure mechanical characteristics of the steel sheets such as strength and elongation according to the compositions and manufacturing conditions of the steel sheets, and results of the tension test were illustrated in Table 7 and FIG. 5.

TABLE 5

| Samples | C | Al | Mn | P | S | Si | Ni | Cr | Ti | B | N | Note |
|---|---|---|---|---|---|---|---|---|---|---|---|---|
| 1 | 0.35 | 1.48 | 11.50 | 0.01 | 0.01 | 0.01 | — | — | — | — | 0.0080 | *CS |
| 2 | 0.59 | 0.00 | 14.92 | 0.02 | 0.01 | 0.01 | 0.140 | 0.30 | 0.044 | 0.0015 | 0.0080 | CS |
| 3 | 0.75 | 1.01 | 15.24 | 0.02 | 0.01 | 0.01 | 0.140 | 0.31 | 0.068 | 0.0017 | 0.0088 | CS |
| 4 | 0.59 | 1.29 | 15.31 | 0.01 | 0.01 | 0.01 | 0.140 | 0.31 | 0.065 | 0.0016 | 0.0080 | **IS |
| 5 | 0.55 | 1.55 | 15.27 | 0.01 | 0.01 | 0.01 | 0.140 | 0.31 | 0.065 | 0.0017 | 0.0071 | IS |
| 6 | 0.58 | 1.81 | 15.13 | 0.01 | 0.01 | 0.01 | 0.140 | 0.31 | 0.064 | 0.0016 | 0.0082 | IS |
| 7 | 0.59 | 2.02 | 15.18 | 0.01 | 0.00 | 0.01 | 0.190 | 0.31 | 0.063 | 0.0016 | 0.0077 | IS |
| 8 | 0.51 | 1.31 | 15.42 | 0.02 | 0.01 | 0.01 | 0.255 | 0.31 | 0.064 | 0.0016 | 0.0078 | IS |
| 9 | 0.50 | 1.56 | 15.04 | 0.02 | 0.00 | 0.01 | 0.256 | 0.31 | 0.064 | 0.0016 | 0.0074 | IS |
| 10 | 0.50 | 1.79 | 15.23 | 0.01 | 0.00 | 0.01 | 0.253 | 0.31 | 0.063 | 0.0017 | 0.0083 | IS |
| 11 | 0.72 | 1.60 | 18.20 | 0.01 | 0.01 | 0.01 | 0.210 | 0.20 | 0.076 | 0.0015 | 0.0078 | CS |
| 12 | 0.60 | 0.05 | 25.00 | 0.01 | 0.01 | 0.06 | — | — | — | — | 0.0068 | CS |

*CS: Comparative Steel,
IS: Inventive Steel

TABLE 6

| Steels | YS (MPa) | TS (MPa) | T-El (%) | Current in three-sheet welding | Cracking by delayed fracture | Note |
|---|---|---|---|---|---|---|
| 1 | 353.0 | 737.0 | 58.0 | 1 kA or greater | Did not occur | Comparative Sample |
| 2 | 500.0 | 1007.0 | 28.6 | 1 kA or greater | Occurred | Comparative Sample |
| 3 | 570.0 | 1004.0 | 41.3 | Less than 1 kA | Did not occur | Comparative Sample |
| 4 | 568.0 | 995.0 | 59.1 | 1 kA or greater | Did not occur | Inventive Sample |
| 5 | 575.0 | 958.0 | 45.4 | 1 kA or greater | Did not occur | Inventive Sample |
| 6 | 578.0 | 940.0 | 48.5 | 1 kA or greater | Did not occur | Inventive Sample |
| 7 | 602.0 | 929.0 | 49.2 | 1 kA or greater | Did not occur | Inventive Sample |
| 8 | 530.0 | 936.0 | 48.9 | 1 kA or greater | Did not occur | Inventive Sample |
| 9 | 537.0 | 909.0 | 52.2 | 1 kA or greater | Did not occur | Inventive Sample |
| 10 | 542.0 | 885.0 | 55.8 | 1 kA or greater | Did not occur | Inventive Sample |
| 11 | 557.0 | 973.0 | 59.4 | Less than 1 kA | Did not occur | Comparative Sample |
| 12 | 353.0 | 772.0 | 45.0 | 1 kA or greater | Occurred | Comparative Sample |

As shown in Table 6, steel sheets having satisfactory welding current ranges and delayed fracture resistance are inventive samples.

Referring to Table 6, steel 1 formed of sample 1 of Table 5 having a carbon content and a manganese content lower than the ranges proposed in the present disclosure had low degrees of strength, ductility, and delayed fracture resistance. Steel 2 formed of sample 2 of Table 5 not including aluminum (Al) had a low degree of delayed fracture resistance, and cracks were formed in steel 2. Furthermore, in the case of steels 3 and 11 formed of samples 3 and 11 of Table 5 each having a carbon content high than the range proposed in the present disclosure, a current range in which three-sheet spot welding was possible was less than 1 kA. In addition, steel 12 formed of sample 12 having a manganese content and a silicon content outside the ranges proposed in the present disclosure had insufficient degrees of strength, ductility, and delayed fracture resistance.

However, steels 3 to 10 formed of inventive steels of Table 5 having optimized contents of carbon (C), manganese (Mn), and aluminum (Al) had a current range of 1 kA or higher for three-sheet spot welding and a satisfactory degree of delayed fracture resistance.

TABLE 7

| Steels | Reduction (%) | YS (MPa) | TS (MPa) | T-El (%) | Note |
|---|---|---|---|---|---|
| 1-1 | 20.1 | 654.9 | 1078.6 | 40.1 | Comparative Sample |
| 1-2 | 29.9 | 802.1 | 1249.5 | 31.2 | Comparative Sample |
| 1-3 | 39.7 | 949.3 | 1420.3 | 22.3 | Comparative Sample |
| 2-1 | 20.1 | 820.0 | 1180.0 | 16.2 | Comparative Sample |
| 2-2 | 30.9 | 941.0 | 1248.0 | 6.3 | Comparative Sample |
| 3 | 34.5 | 980.0 | 1299.5 | 12.4 | Comparative Sample |
| 4 | 35.0 | 1233.0 | 1593.0 | 12.3 | Inventive Sample |
| 5 | 37.3 | 1250.0 | 1596.0 | 11.2 | Inventive Sample |
| 6 | 37.6 | 1261.0 | 1587.0 | 11.6 | Inventive Sample |
| 7-1 | 36.4 | 1260.0 | 1604.0 | 10.9 | Inventive Sample |
| 7-2 | 36.4 | 1226.0 | 1546.0 | 8.7 | Inventive Sample |
| 7-3 | 40.8 | 1271.0 | 1615.0 | 10.4 | Inventive Sample |
| 7-4 | 43.4 | 1287.0 | 1633.0 | 10.3 | Inventive Sample |
| 8-1 | 32.4 | 1178.0 | 1498.0 | 11.8 | Inventive Sample |
| 8-2 | 36.9 | 1233.0 | 1563.0 | 10.3 | Inventive Sample |
| 8-3 | 38.2 | 1262.0 | 1594.0 | 10.0 | Inventive Sample |
| 8-4 | 41.9 | 1325.0 | 1666.0 | 9.3 | Inventive Sample |
| 9-1 | 32.4 | 1152.0 | 1451.0 | 11.6 | Inventive Sample |
| 9-2 | 35.3 | 1209.0 | 1525.0 | 10.4 | Inventive Sample |
| 9-3 | 39.9 | 1259.0 | 1576.0 | 9.8 | Inventive Sample |
| 9-4 | 40.8 | 1283.0 | 1612.0 | 9.5 | Inventive Sample |
| 10-1 | 18.0 | 918.0 | 1240.0 | 20.2 | Comparative Sample |
| 10-2 | 31.0 | 1088.0 | 1390.0 | 12.2 | Inventive Sample |
| 10-3 | 36.7 | 1188.0 | 1499.0 | 10.7 | Inventive Sample |
| 10-4 | 39.6 | 1231.0 | 1541.0 | 10.4 | Inventive Sample |
| 10-5 | 44.7 | 1294.0 | 1613.0 | 8.0 | Inventive Sample |
| 11-1 | 20.1 | 858.9 | 1286.3 | 41.5 | Comparative Sample |
| 11-2 | 30.5 | 934.3 | 1150.0 | 32.2 | Comparative Sample |
| 11-3 | 39.7 | 980.0 | 1276.0 | 24.0 | Comparative Sample |
| 12-1 | 19.9 | 651.9 | 1111.9 | 27.2 | Comparative Sample |
| 12-2 | 29.8 | 800.6 | 1281.0 | 18.4 | Comparative Sample |
| 12-3 | 39.9 | 952.3 | 1453.6 | 5.4 | Comparative Sample |

Table 7 illustrates results of evaluation of the strength of the steel sheets which were prepared from the steel ingots having the compositions shown in Table 5 through the hot rolling process, the cold rolling process, and the re-rolling process inducing work hardening.

Referring to Table 7, steel sheets having high degrees of tensile strength, yield strength, and elongation according to the reduction ratios in the re-rolling process are Inventive Samples.

As shown in Table 7, steels formed of sample 1 of Table 5 having contents of carbon (C) and manganese (Mn) lower than the ranges proposed in the present disclosure had low degrees of yield strength. Particularly, when the reduction ratio of the re-rolling process was less than 30%, yield strength was relatively low compared to the case in which the reduction ratio of the re-rolling process was 30% or greater. In addition, steel sheets formed of samples 3 or 11 having a carbon content higher than the range proposed in the present disclosure had a low degree of yield strength or tensile strength even though the reduction ratio of the re-rolling process was greater than 30%. Particularly, when the reduction ratio of the re-rolling process was less than 30%, strength was further decreased. In addition, the contents of manganese (Mn) and silicon (Si) in steels prepared using sample 12 of Table 5 were outside the ranges proposed in the present disclosure, and thus the yield strength of the steels was low. In addition, when the reduction ratio of the re-rolling process was less than 30%, yield strength was lower than the case in which the reduction ratio of the re-rolling process was 30% or higher. Therefore, it could be understood that when a re-rolling process is performed at a reduction ratio of 30% or greater, high degrees of yield strength and tensile strength are guaranteed.

Along with this, so as to evaluate the effect of the re-rolling process on the microstructure of steel and the yield strength and tensile strength of the steel, the microstructure of inventive steel 7 was observed by electron backscattered diffraction (EBSD) before and after the re-rolling process, as illustrated in FIG. 4.

As illustrated in FIG. 4, the average size of grains was about 10 μm before the re-rolling process. However, after the re-rolling process, the average size of grains was about 5 μm owing to grain refinement. In addition, the twin faction of inventive steel 7 was also increased owing to the re-rolling process. As described above, it may be understood that since a re-rolling process induces grain refinement and the formation of twins, the yield strength and tensile strength of steel are increased.

FIG. 5 is a graph illustrating the tensile strength and yield strength of comparative examples and inventive examples of Table 7. That is, the ranges of the tensile strength and yield strength of comparative examples and inventive examples are illustrated in FIG. 5. As illustrated in FIG. 5, according to the reduction ratio of a re-rolling process, a yield strength range of 1000 MPa or greater and a tensile strength range of 1300 MPa or greater that are required for automotive crashworthy members may be obtained according to the present disclosure.

The invention claimed is:

1. An ultrahigh-strength steel sheet comprising, by wt %, carbon (C): 0.4% to 0.7%, manganese (Mn): 12% to 24%, aluminum (Al): 0.01% to 3.0%, silicon (Si): 0.3% or less, phosphorus (P): 0.03% or less, sulfur (S): 0.03% or less, nitrogen (N): 0.04% or less, nickel (Ni): 0.05% to 1.0%, chromium (Cr): 0.05% to 1.0%, and tin (Sn): 0.01% to 0.03%, and a balance of iron (Fe) and inevitable impurities, wherein the ultrahigh-strength steel sheet comprises single phase austenite as a microstructure.

2. The ultrahigh-strength steel sheet of claim 1, wherein the microstructure of the ultrahigh-strength steel sheet comprises grains in an amount of 70% or greater that have an aspect ratio of 2 or greater in a rolling direction by an effect of work hardening.

3. The ultrahigh-strength steel sheet of claim 1, further comprising titanium (Ti): 0.005% to 0.10%, boron (B): 0.0005% to 0.0050%.

4. The ultrahigh-strength steel sheet of claim 3, wherein the microstructure of the ultrahigh-strength steel sheet has an average grain size within a range of 2 μm to 10 μm by an effect of work hardening.

5. The ultrahigh-strength steel sheet of claim 1, wherein the steel sheet has a tensile strength of 1300 MPa or greater and a yield strength of 1000 MPa or greater.

6. The ultrahigh-strength steel sheet of claim 1, wherein the ultrahigh-strength steel sheet is one of a cold-rolled steel sheet, a hot-dip plated steel sheet, a hot-dip alloy plated steel sheet, and an electroplated steel sheet.

7. A method for manufacturing an ultrahigh-strength steel sheet, the method comprising:

heating a steel ingot or a continuously cast slab to 1050° C. to 1300° C. for homogenization, the steel ingot or continuously cast slab comprising, by wt %, carbon (C): 0.4% to 0.7%, manganese (Mn): 12% to 24%, aluminum (Al): 0.01% to 3.0%, silicon (Si): 0.3% or less, phosphorus (P): 0.03% or less, sulfur (S): 0.03% or less, nitrogen (N): 0.04% or less, nickel (Ni): 0.05% to 1.0%, chromium (Cr): 0.05% to 1.0%, and tin (Sn): 0.01% to 0.03%, and a balance of iron (Fe) and inevitable impurities;

hot rolling the homogenized steel ingot or continuously cast slab at a finish hot rolling temperature of 850° C. to 1000° C. so as to form a hot-rolled steel sheet;

coiling the hot-rolled steel sheet within a temperature range of 200° C. to 700° C.;

cold rolling the coiled steel sheet at a reduction ratio of 30% to 80% to form a cold-rolled steel sheet;

continuously annealing the cold-rolled steel sheet within a temperature range of 400° C. to 900° C.; and re-rolling the continuously annealed steel sheet.

8. The method of claim 7, wherein the steel ingot or continuously cast slab further comprises titanium (Ti): 0.005% to 0.10%, boron (B): 0.0005% to 0.0050%.

9. The method of claim 7, wherein the re-rolling is performed through one of a skin pass milling process, a double reduction rolling process, a hot rolling finishing process, and a continuous rolling process.

10. The method of claim 7, wherein the re-rolling is performed at a reduction ratio of 30% to 50%.

11. The method of claim 7, wherein after the continuous annealing, the method further comprises electroplating or hot-dip plating the continuously annealed steel sheet.

* * * * *